United States Patent [19]

Lennon

[11] 3,971,907

[45] July 27, 1976

[54] ELECTRICAL ASSEMBLY, ELECTRICAL CONTACT AND METHOD OF MOUNTING AN ELECTRICAL CONTACT

[75] Inventor: David C. Lennon, Morrison, Ill.

[73] Assignee: General Electric Company, Fort Wayne, Ind.

[22] Filed: Feb. 22, 1974

[21] Appl. No.: 445,300

[52] U.S. Cl. ..... 200/238; 29/630 C

[51] Int. Cl.[2] ..... H01R 9/00

[58] Field of Search ..... 200/238, 267; 29/630 C

[56] References Cited

UNITED STATES PATENTS

| | | | |
|---|---|---|---|
| 991,661 | 5/1911 | Steen | 200/238 |
| 1,301,310 | 4/1919 | Paroubek | 29/630 C X |
| 2,181,083 | 11/1939 | Payette | 29/630 C |
| 2,252,899 | 8/1941 | Reynolds | 29/630 C |
| 3,299,239 | 1/1967 | Mawney et al. | 29/630 C |
| 3,377,700 | 4/1968 | Cooley | 29/630 C |
| 3,536,865 | 10/1970 | Meyer | 200/11 D |

*Primary Examiner*—Herman T. Hohauser
*Attorney, Agent, or Firm*—Joseph E. Papin

[57] ABSTRACT

An electrical contact adapted to be mounted to a supporting member. The contact has a body with a peripheral portion, and a plurality of means is provided adjacent the peripheral portion for mounting the body in displacement preventing engagement with the supporting member.

A method of mounting an electrical contact to a supporting member therefor and an assembly of an electrical contact and a supporting member are also disclosed.

12 Claims, 9 Drawing Figures

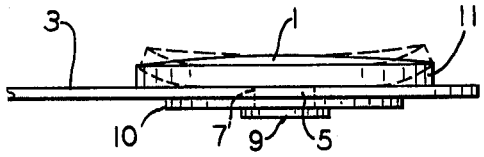
FIG. 1
PRIOR ART
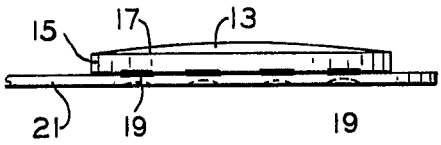
FIG. 2
PRIOR ART
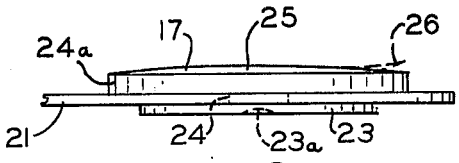
FIG. 2A
PRIOR ART
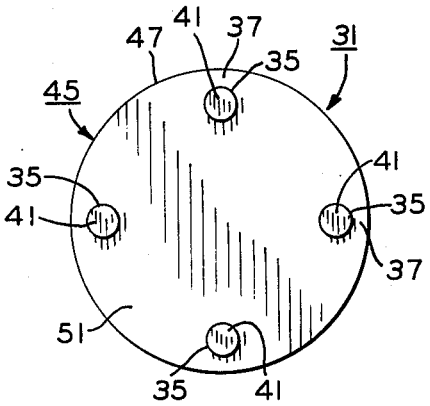
FIG. 3
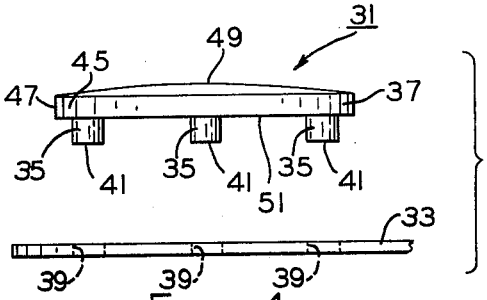
FIG. 4
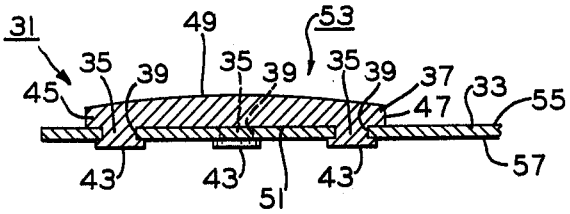
FIG. 6
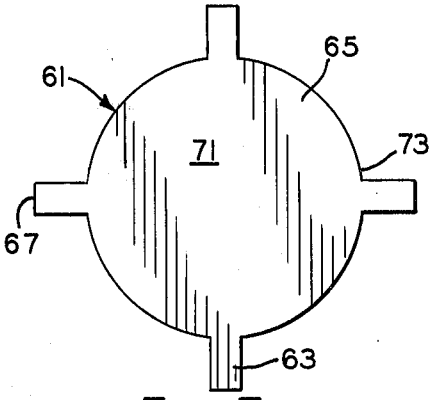
FIG. 7
FIG. 5
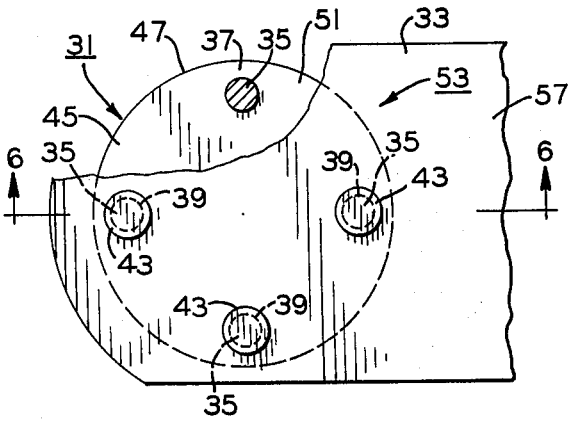
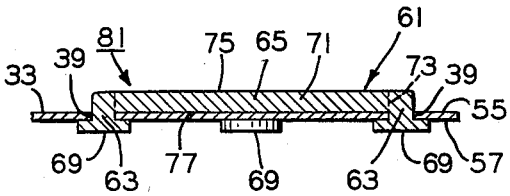
FIG. 8

ELECTRICAL ASSEMBLY, ELECTRICAL CONTACT AND METHOD OF MOUNTING AN ELECTRICAL CONTACT

BACKGROUND OF THE INVENTION

This invention relates generally to electrical contacts and in particular to those having means for preventing warpage thereof, an assembly including a supporting member and such electrical contact, and a method of mounting such electrical contact on the supporting member.

In the past, various electrical switching means were provided with a supporting member, such as a power conducting terminal or buss or a generally thin, resilient metal switch blade or contact operating arm to which an electrical contact was mounted. When the electrical contact was mounted on the switch blade, it was movable or pivotable under preselected conditions between a making position engaging its contact with a stationary contact mounted on a stationary switch blade or buss and another or breaking position disengaged therefrom. Some of the past electrical contacts were formed from a metal or metal alloy having relatively high conductive characteristics, such as silver or an alloy thereof or the like, and a centrally located rivet or deformable stem was integrally formed on the past electrical contacts for mounting them to the switch blade. To effect such mounting, the integrally formed rivet was passed through an accommodating opening in the switch blade to position the electrical contact generally in face-to-face relation with one side of the switch blade, and the rivet was then deformed or staked over into displacement preventing engagement with the opposite side of the switch arm. One of the disadvantageous or undesirable features of the past electrical contacts and the assembly thereof to a switch blade is believed to be that under some load conditions, the past electrical contacts were subject to curling or warping. The phenomenon of contact curling or warping was occasioned in response to heat generated in the contact upon the application of power thereto causing at least a marginal or peripheral portion or edge thereof to be displaced or move away from the power carrying switch blade. Another disadvantageous or undesirable feature of such past contact and the assembly thereof to a switch blade is believed to be that upon the occurrence of such curling or warping, the gap between the contact and its associated mating contact could be reduced to zero and/or the contacts could become welded to each other. Of course, a past solution to this problem of contact curling or warping with respect to a riveted type contact was to either increase the thickness of the contact and/or increase the diameter of the mounting rivet thereof; however, either of these solutions also involved the ancillary disadvantageous features of increasing the size of the contact as well as the cost thereof.

Also in the past, laminated contacts were brazed, welded or otherwise fixedly engaged generally at a single generally central location with a switch blade therefor, but some of the laminated contacts and the assembly thereof to the switch blade also involved substantially the same disadvantageous or udesirable feature of curling or warping, as previously discussed hereinabove. An ancillary disadvantageous feature with respect to the utilization of the past laminated contact is believed to be that precious metals were laminated to a base conductive metal thereby to appreciably increase the cost of the laminated contact relative to the above discussed prior art rivet type contact. Still another ancillary disadvantageous feature with respect to the utilization of laminated contacts is believed to be that it was more costly to attach by brazing or welding or the like than to rivet the rivet type contact. Further, another disadvantageous or undesirable feature of the past laminated contact and its assembly to the switch arm is believed to be that the precious metal sometimes delaminated from its base metal upon the occurrence of the curling or warping phenomenon. Still another disadvantageous or undesirable feature of both the past rivet type contact and the laminated contact and their respective assembly with their switch blades is believed to be that it was sometimes necessary to provide a back-up washer or the like for strengthening the switch blade to support the contact. Of course, another past solution to the curling or warping problem was to utilize a laminated type contact having multiple welding projections generally adjacent the peripheral portion of the laminated contact, and these multiple welding projections were welded to a switch blade; however, one of the disadvantageous features of this particular type of laminated contact is believed to be that the precious metal laminate thereof made it more costly than the aforementioned rivet type contact.

SUMMARY OF THE INVENTION

Among the several objects of the present invention may be noted the provision of an electrical contact, an assembly thereof with a supporting member, and a method of mounting the contact and supporting member which overcome the disadvantageous or undesirable features discussed hereinabove, as well as others, with respect to the prior art; the provision of such electrical contact, assembly, and method in which means for mounting the contact and supporting member also may be utilized to prevent the aforementioned curling or warping phenomenon; the provision of such electrical contact, assembly, and method in which a generally more economical means for mounting the contact and the supporting member may be utilized; the provision of such electrical contact, assembly and method in which the means for mounting the contact and supporting member also predetermines the relative positions thereof; the provision of such electrical contact, assembly, and method in which the means for mounting the contact and supporting member may also be utilized to prevent relative displacement therebetween while the contact and switch blade are being connected together; and the provision of such electrical switch and assembly wherein the components thereof are simplistic of design, economically manufactured, and easily assembled. Other objects and features of the present invention will be in part apparent and in part pointed out hereinafter.

In general and in one form of the invention, an electrical contact adapted to be mounted to a supporting member comprises a contact body having a peripheral portion and a plurality of means adjacent the peripheral portion for mounting the contact body in displacement preventing engagement with the supporting member.

More particularly and also in one form of the invention, the mounting means for the electrical contact includes a plurality of rivets integrally formed with the contact body adjacent the peripheral portion, and the rivets extend through the supporting member. The free ends of the rivets are deformed into the displacement preventing engagement with the supporting member and prevent movement of the peripheral portion generally away from the switch arm in response to heat generated in the contact body when power is applied thereto.

Also in general, an assembly in one form of the invention includes an electrical contact and a supporting member. A marginal portion is provided on the contact adjacent the switch blade, and means on the contact mounts it to the switch blade and prevents displacement of at least a part of the marginal portion relative to the supporting member in response to heat generated in the contact when power is applied thereto.

Further in general, a method in one form of the invention is provided for mounting an electrical contact having an outer peripheral portion of a seating face thereof maintained in seating engagement on one of a pair of opposite sides of a supporting member against deforming displacement movement away therefrom in response to bending moments created in the electrical contact due to heat generated therein when it is electrically energized. In this method, a plurality of integrally formed extensions on the electrical contact and spaced at least closely adjacent the outer peripheral portion thereof are passed through a plurality of openings in the supporting member intersecting between the opposite sides thereof, respectively. At least the outer peripheral portion of the seating face is disposed in the seating engagement with the one opposite side of the supporting member. Respective end portions of the integrally formed extensions adjacent the other of the opposite sides of the supporting member are deformed into clamping engagement therewith generally about the openings and overlaying the outer peripheral portion with at least a part of the deformed end portions so as to establish forces for tightly clamping the outer peripheral portion in its seating engagement to the one opposite side of the supporting member against the deforming displacement movement away therefrom in response to the bending moments created in the electrical contact due to the heat generated therein when it is electrically energized.

Also in general, a method is provided in one form of the invention for making an electrical contact and assembling it to means for supporting it having a pair of opposite sides with a plurality of openings intersecting therebetween. This method includes the steps of: integrally forming a plurality of means on a face of the contact at least closely adjacent an outer peripheral portion of the face for mounting the contact to the supporting means; inserting the plurality of integrally formed means respectively through the openings in the supporting means and seating the outer peripheral portion in engagement with one of the opposite sides; and deforming respective end portions of the integrally formed means extending through the openings beyond the other of the opposite sides of the supporting means into clamping engagement with the other opposite side and laying at least a part of the deformed end portions over the outer peripheral portion in spaced relation therewith so as to establish forces preventing deforming displacement movement of the outer peripheral portion away from the one opposite side in response to bending moments created in the contact upon electrical energization heating thereof.

BRIEF DESCRIPTION OF THE DRAWINGS

FIGS. 1, 2, and 2A are side elevational views illustrating prior art rivet and laminated type electrical contacts in assembled relation with supporting members therefor with the disadvantageous curling or warping effect shown in phantom;

FIG. 3 is a bottom elevational view of an electrical contact in one form of the present invention;

FIG. 4 is an exploded view showing the electrical contact of FIG. 3 in side elevation and displaced from assembled relation with a supporting member therefor;

FIG. 5 is a bottom elevational view of an assembly of the electrical contact and switch blade in one form of the present invention and teaching principles of a method for mounting the electrical contact and supporting member also in one form of the present invention;

FIG. 6 is a sectional view taken along lines 6—6 of FIG. 5.

FIG. 7 is a plan view of an alternative electrical contact in its blanked out form also in one form of the present invention; and FIG. 8 is a sectional view of the alternative electrical assembly in one form of the invention showing the contact of FIG. 9 assembled with a supporting member therefor and teaching principles of a method of mounting the alternative electrical contact also in one form of the present invention.

Corresponding reference characters indicate corresponding parts throughout the several views of the drawing.

The following examples illustrate the invention and are not to be construed as limiting in any manner.

DESCRIPTION OF THE PREFERRED EMBODIMENTS

Referring to a prior art electrical contact 1 in assembly curls, with a switch blade 3, as shown in FIG. 1, a shank or rivet portion 5 which is integrally and generally centrally provided on the contact extends through an opening 7 in the switch blade, and the lower or free end of the rivet portion is deformed at 9 into abutment with the switch blade thereby to fixedly mount the contact to the switch blade. A back-up washer 10 may, if desired, be interposed between the deformed free end 9 of rivet portion 5 for switch blade strengthening purposes. As may be seen by the phantom line in FIG. 1, at least a part of a marginal or peripheral portion 11 of contact 1 curles, warps or is displaced away from switch blade 3 in response to heat generated upon the application of power through the switch blade and contact. In FIG. 2, a prior art laminated electrical contact 13 is provided with a conductive disc shaped body 15 of copper, steel or other conductive metal, and a lamination of precious metal having relatively great conductive characteristics, such as gold, silver or alloys thereof as indicated at 17, is laminated to the body. A plurality of weld projections may be provided on the body 15 for attachment by suitable means, such as soldering, brazing or welding or the like, as indicated at 19, to another switch blade 21 thereby to fixedly mount laminated contact 13. As previously mentioned, welding of the multiple welded projections generally obviates the curling or warping problem. In some instances instead of welding the multiple weld projections of contact 13 directly to switch blade 21, a back-up washer 23 or the like may, if desired, be attached by suitable means, such as welding or the like at 23a, through an aperture 24 in switch blade 21 directly to the central portion of a body 24a of a prior art laminated contact 25 for switch blade strengthening purposes, FIG. 2A. As may be seen by the phantom lines in FIG. 2A, at least a part of a marginal or peripheral portion 26 of laminate 17 on contact 25 may, in some instances, curl or warp away from body 24a in response to heat generated upon the application of power through the laminated contact and its switch blade 21.

Referring now in general to FIGS. 3–6, there is illustrated a method in one form of the present invention for mounting an electrical contact 31 to a supporting member 33 which shall be referred to hereinafter as a switch blade, but it is understood that a terminal or a buss may also be utilized as the supporting member within the scope of this invention. In this method, a plurality of means, such as projections, extensions or rivets 35, are initially integrally formed on contact 31 adjacent a marginal or peripheral portion 37 thereof for mounting to switch blade 33, and the integrally formed or mounting means or rivets are inserted through means, such as a plurality of openings 39, in the switch blade for accommodating them. At least a portion, such as a free end portion 41 of each of rivets 35 extending through accommodating means or openings 39, is subsequently deformed, such as by staking, swaging, peening or the like, as well known in the art, into displacement preventing engagement with switch blade 33. In this manner, there is illustrated a method in one form of the invention in which electrical contact 31 is disposed on switch blade 33 generally in face-to-face relation, and peripheral portion 37 of the contact is maintained generally against displacement relative to the switch blade in response to heating of the contact upon applying power thereto.

More particularly with regard to the aforementioned method illustrated in FIGS. 3–6, rivets 35 are initially integrally formed on contact 31 adjacent peripheral portion 37 thereof, and while only four such rivets are shown for purposes of disclosure, it is contemplated that any desired number thereof may be utilized within the scope of the invention for maintaining at least a part of the peripheral portion against displacement from its generally face-to-face relation or abutment with switch blade 33. Rivets 35 are aligned with openings 39 of switch blade 33 (FIG. 4) prior to the insertion of the rivets through the openings, as discussed above, and upon such inserting of the rivets, contact 31 is predeterminately disposed or positioned relative to the switch blade for connection in displacement preventing engagement therewith (FIGS. 5 and 6). When rivets 35 are so disposed within switch blade openings 39, the engagement therebetween acts to prevent relative displacement of contact 31 and switch blade 33 upon the subsequent deformation of free ends 41 of the rivets by swagging, staking, peening or other suitable means well known in the art as previously mentioned, to form generally laterally extending head portions 43 on the rivet for gripping or abutting engagement with the switch blade thereby to prevent displacement of the rivets through the openings and for tightly clamping peripheral portion 37 in seating engagement to the switch blade. Of course, various types of fixturing may be utilized for aligning and assemblying contact 31 and switch blade 33 and for deforming rivet free ends 41 to form heads 43, as well known in the art, but for the sake of brevity, such fixturing is omitted. It may be noted that the provision of rivets 35 adjacent peripheral portion 37 of contact 31 and the interconnections of rivet heads 43 with switch blade 33 generally define force acting on the contact in opposition to a bending moment tending to displace the peripheral portion from its face-to-face relation with the switch blade, the bending moment being created or effected by heat generated in the contact and switch arm upon the application thereto of power, as discussed hereinafter.

Referring now with particularity to FIGS. 3–6, there is shown electrical contact 31, in one form of the invention, which is adapted to be mounted to switch blade 33. Contact 31 is provided with a generally disc shaped body 45 having an outer peripheral portion 37, and an outer marginal or peripheral edge 47 generally defines the extremity of the peripheral portion. Body 45 may be formed from metals or alloys thereof having rather high thermal and electrical conductive characteristics or properties, such as copper, aluminum, silver, gold or the like. While contact body 45 is shown as generally disc shaped or round for purposes of disclosure, it is also contemplated that various other shaped contact bodies may be utilized within the scope of the invention, such as for instance generally oval or elliptical shapes, generally rectangular shapes, or generally annular shapes. Contact body 45 is also provided with a generally dome-shaped upper or contact surface or face 49 for making and breaking engagement with a mating contact (not shown), and a generally planar lower or abutment surface or face 51 which includes peripheral portion 37 is provided on the contact body opposite the contact surface for abutting engagement or face-to-face disposition with switch blade 33. Rivets 35 are integrally formed on lower or seating face 51 of contact body 45 preferably adjacent peripheral portion 37 and may be spaced a desired distance from marginal edge 47; however, it is contemplated that the rivets may, if desired, be disposed generally coterminously with the marginal edge within the scope of the invention, as discussed hereinafter with respect to FIGS. 7 and 8. Rivets 35 extend generally normally with respect to lower face 51 of contact body 45 terminating at free ends 41, and while the rivets are shown as generally cylindric in shape, it is understood that they may be tapered or otherwise shaped and may be of any desired length within the scope of the invention.

Referring now with particularity to FIGS. 5 and 6, there is illuatrated in one form of the invention an assembly, indicated generally at 53, constituted by contact 31 and supporting member 33. As previously mentioned, supporting member 33 may be constituted by a switch blade formed from a generally thin resilient strip of metal or metal alloy having rather high electrical and thermal conductive characteristics or properties, such as copper, a copper alloy or a phopherous bronze alloy for instance, or may be constituted by a buss or terminal having similar properties. Switch blade 33 is provided with opposite or upper and lower sides or surfaces 55, 57, and openings 39 extend through the switch blade intersecting the opposite surfaces thereof for accommodating rivets 35 of contact 31. Lower face 51 of contact 31 is mounted in seating or abutting engagement or generally in face-to-face relation with switch blade upper surface 55, and rivets 35 engage the side walls of openings 39 to generally prevent or limit displacement movement of contact 31 in lateral directions (as seen in FIGS. 5 and 6) relative to switch blade 33. Means, such as rivet heads 43, are provided for deformation into clamping engagement with switch blade lower surface 57 generally about openings 39 thereby to prevent displacement of contact 31 from switch blade 33 and to clamp peripheral portion 37 of the contact in its seating engagement to the switch blade, and it may be noted that the extent or spread of the rivet heads generally along the switch blade lower surface constitute a means for backing-up or strengthening the switch blade. Further, since rivets 35 are predeterminately disposed adjacent peripheral portion 37 of contact 31, the engagement of rivet heads 43 with switch blade lower surface 51 establishes the forces with respect to contact peripheral portion 37 generally opposing any bending moments occasioning curling, warping or displacement movement thereof away from its engagement with switch blade upper surface 55 in response to heat generated in contact 31 and switch blade 33 upon the application of power thereto, as previously mentioned. The bending moment may be thought of as being defined generally between the central portion of contact 31 and its marginal edge 47.

Referring now in general to FIGS. 7 and 8, there is shown a method in one form of the present invention for mounting an electrical contact 61 to a switch blade 33 therefor. In this method a plurality of means, such as projections, extensions, tabs or rivets 63, are initially integrally formed on contact 61 generally in the plane thereof and adjacent a marginal or peripheral portion 65 thereof for mounting to switch blade 33, and the mounting means or rivets are then bent so as to depend from the contact for alignment with and insertion through means, such as the plurality of openings 39, in the switch blade for accommodating them. At least a portion, such as a free end portion 67 of each of rivets 63 extending through accommodating means or openings 39, is subsequently deformed, such as by staking, swagging, peening or the like, as well known in the art, into displacement preventing engagement with switch blade 33. In this manner, there is illustrated a method in one form of the invention in which electrical contact 61 is disposed on switch blade 33 generally in face-to-face relation, and peripheral portion 65 of the contact is maintained generally against displacement relative to the switch blade in response to heating of the contact upon applying power thereto.

More particularly with regard to the aforementioned method illustrated in FIGS. 7 and 8, rivets 63 are initially integrally formed on contact 61 adjacent peripheral portion 37 thereof, and while only four such rivets are shown for purposes of disclosure, it is contemplated that any desired number thereof may be utilized within the scope of the invention for maintaining or clamping at least a part of the peripheral portion against displacement from its generally face-to-face relation or abutment with switch blade 33. Rivets 63 are bent for alignment with openings 39 and then aligned therewith prior to the insertion of the rivets through the openings, as shown in FIG. 8 and discussed above, and upon such inserting of the rivets, contact 61 is predeterminately disposed or positioned relative to the switch blade for connection in displacement preventing engagement therewith. When rivets 63 are so disposed within switch blade openings 39, the engagement therebetween acts to prevent relative displacement of contact 61 and switch blade 33 upon the subsequent deformation of free ends 67 of the rivets by swagging, staking, peening or other suitable means well known in the art as previously mentioned, to form generally laterally extending head portions 69 on the rivet for gripping or abutting engagement with the switch blade thereby to prevent displacement of the rivets through the openings as previously mentioned, various types of fixturing may be utilized for aligning and assemblying contact 61 and switch blade 33 and for deforming rivet free ends 67 to form heads 69, as well known in the art, but for the sake of brevity, such fixturing is omitted. It may be noted that the provision of rivets 63 adjacent peripheral portion 65 of contact 61 and the interconnections of rivet heads 69 with switch blade 33 generally define a moment with respect to the peripheral portion opposing displacement thereof from its face-to-face relation with the switch blade which may tend to be effected by heat generated in the contact and switch arm upon the application thereto of power.

Referring now with particularity to FIGS. 7 and 8, there is shown electrical contact 61, in one form of the invention, which is adapted to be mounted to switch blade 33. Contact 61 is provided with a generally disc shaped body 71 having peripheral portion 65, and a marginal or peripheral edge 73 generally defines the extremity of the peripheral portion. Body 71 may be formed from metals or alloys thereof having rather high thermal and electrical conductive characteristics or properties, such as copper, aluminum, silver, gold or the like. While contact body 71 is shown as generally disc shaped or round for purposes of disclosure, it is also contemplated that various other shaped contact bodies may be utilized within the scope of the invention, such as for instance generally oval or elliptical shapes, generally rectangular shapes, or generally annular shapes. Contact body 71 is also provided with a generally flat upper or contact surface or face 75 for making and breaking engagement with a mating contact (not shown), but upper surface 75 may be dome shaped, if desired, as illustrated with respect to contact 31 in FIGS. 3–6. A generally planar lower or abutment surface or face 77 is provided on the contact body opposite upper surface 75 for abutting engagement or face-to-face disposition with switch blade 33. Rivets 63 are originally integrally formed with contact body 71 generally in the plane thereof adjacent peripheral portion 65 and spaced about marginal edge 73. It may be noted that while rivets 63 are originally integrally formed with contact body 71 adjacent its peripheral portion 65, the rivets extend generally radially outwardly with respect to the peripheral portion (as seen in FIG. 8) being connected to marginal edge 73 and spaced thereabout. Rivets 63 are subsequently bent or otherwise shaped so as to depend from contact body 71 for alignment with openings 39 in switch blade 33 and the rivets extend generally normally with respect to lower face 77 of the contact body terminating at free ends 67, as previously mentioned. While the rivets are shown as generally square in cross-section, it is understood that they may be tapered or otherwise shaped and have any desired length within the scope of the invention.

Referring now with particularity to FIG. 8, there is illustrated an assembly, indicated generally at 81, constituted by contact 61 and supporting member 33. As previously mentioned, supporting member 33 may be constituted by a switch blade formed from a generally thin resilient strip of metal or metal alloy having rather high electrical and thermal conductive characteristics or properties, such as copper, a copper alloy or a phopherous bronze alloy for instance, or may be constituted by a buss or terminal having similar properties. Lower face 77 of contact 61 is mounted in abutment or generally in face-to-face relation with switch blade upper surface 55, and rivets 63 engage the side walls of openings 39 to generally prevent or limit displacement movement of contact 61 in lateral directions (as seen in FIG. 8) relative to switch blade 33. Rivet heads 69 are deformed into engagement with switch blade lower surface 57 generally about openings 39 thereby to prevent displacement of contact 61 from switch blade 33 and clamp the peripheral portion of contact lower face 77 in its seating engagement to the switch blade. It may be noted that the extent or spread of the rivet heads generally along the switch blade lower surface constitute a means for backing-up or strengthening the switch blade. Further, since rivets 63 are predeterminately disposed adjacent peripheral portion 65 of contact 61, the engagement of rivet heads 69 with switch blade lower surface 51 establishes the forces with respect to contact peripheral portion 65 generally opposing the bending moment occasioning curling, warping or displacement movement thereof away from its engagement with switch blade upper surface 55 in response to heat generated in contact 61 and switch blade 33 upon the application of power thereto, as previously mentioned.

From the foregoing, it is now apparent that novel electrical contacts 31, 61, electrical assemblies 53, 81 and methods of mounting electrical contacts to a supporting member 33 are presented meeting the objects and advantages therefor set out hereinbefore, as well as other objects and advantages, and that changes as to the precise arrangements, shapes, and details of the constructions illustrated herein by way of example for purposes of disclosure, as well as the precise steps of the method, may be made by those having ordinary skill in the art without departing from the spirit of the invention or the scope thereof which is defined by the claims which follow.

I claim:

1. An electrical contact adapted to be mounted to a supporting member having generally opposite sides with a plurality of predeterminately spaced openings extending therebetween, said electrical contact comprising a contact body having a pair of generally opposite faces, one of said faces being adapted for electrical contacting engagement to effect electrical energization of said electrical contact and the other of said faces being adapted for seating engagement on one of the opposite sides of the supporting member, said other face including an outer peripheral portion adapted to be clamped tightly against the one opposite side of the supporting member so as to prevent deforming displacement movement away therefrom of said outer peripheral portion in response to bending moments created in said contact body upon the generation of heat in said electrical contact when it is electrically energized, a plurality of integrally formed means on said contact body and predeterminately disposed in spaced apart relation at least closely adjacent said outer peripheral portion for respectively extending through the openings in the supporting member when said other face is in seating engagement with the one opposite side of the supporting member, and said integrally formed means including means for deformation into clamping engagement with the other of the opposite sides of the supporting member generally about the openings thereof and at least in part spaced in overlaying relation with said outer peripheral portion so as to tightly clamp it against the one opposite side in opposition to the deforming displacement movement away therefrom occasioned in response to the bending moments created in said contact body upon the heating of said electrical contact when it is electrically energized.

2. An electrical contact as set forth in claim 1 wherein said integrally formed means comprise a plurality of rivets integral with said contact body and depending generally therefrom with respect to said other face.

3. An electrical contact as set forth in claim 2 wherein said deformation means comprise free end portions on said rivets adapted to be deformed into the clamping engagement with the other opposite side of the supporting member.

4. An electrical contact as set forth in claim 1 wherein said contact body includes a marginal edge intersecting with said faces and generally defining the extremity of said outer peripheral portion, said integrally means being predeterminately spaced apart generally about said marginal edge.

5. An electrical contact adapted to be mounted to a supporting member having opposite sides with a plurality of openings extending therebetween, said electrical contact comprising a contact body having an outer marginal edge, a surface on said contact body intersecting with said outer marginal edge for seating engagement with one of the opposite sides of the supporting member and including an outer peripheral portion generally adjacent said outer marginal edge, a plurality of integrally formed rivets on said surface at least closely adjacent said outer peripheral portion thereof and generally depending from said surface for extending through the openings in the supporting member, and free end portions on said integrally formed rivets adapted to be deformed into heads for engagement with the other of the opposite sides of the supporting member so as to extend at least in part in spaced overlaying relation with at least a part of said outer peripheral portion, said integrally formed rivets and their heads generally constituting means for establishing forces urging said outer peripheral portion into displacement preventing engagement with the one opposite side of the supporting member so as to prevent warpage of said outer peripheral portion away from the one opposite side of the supporting member and opposing bending moments generally between the central portion of said contact body and said outer marginal edge tending to effect such warpage and created in response to generated heat by power applied to said contact when it is mounted to the supporting member.

6. An electrical assembly adapted to be electrically energized comprising a switch blade and an electrical contact, said switch blade including a pair of generally opposite sides, and a plurality of openings through said switch blades intersecting with said opposite sides, and said electrical contact including a body, a face on said body disposed in seating engagement on one of said opposite sides of said switch blade, an outer peripheral portion on said face, a plurality of integrally formed means on said body and predeterminately disposed at least closely adjacent said outer peripheral portion for respectively extending through said openings, and means on said integrally formed means for respective deformation into clamping engagement with the other of said opposite sides of said switch blade generally about said openings and at least in part spaced in overlaying relation with said outer peripheral portion so as to tightly clamp it against said one opposite side in opposition to deforming displacement movement away therefrom of said outer peripheral portion occasioned in response to bending moments created in said body upon heating of said electrical contact when it is electrically energized.

7. A method of mounting an electrical contact having an outer peripheral portion of a seating face thereof maintained in seating engagement on one of a pair of opposite sides of a supporting member against deforming displacement movement away therefrom in response to bending moments created in the electrical contact due to heat generated therein when it is electrically energized, said method comprising the steps of:

a. passing a plurality of integrally formed extensions on the electrical contact and spaced at least closely adjacent the outer peripheral portion thereof through a plurality of openings in the supporting member intersecting between the opposite sides thereof, respectively;

b. disposing at least the outer peripheral portion of the seating face in the seating engagement with the one opposite side of the supporting member; and c. deforming respective end portions of the integrally formed extensions adjacent the other of the opposite sides of the supporting member into clamping engagement therewith generally about the openings and overlaying the outer peripheral portion with at least a part of the deformed end portions so as to establish forces for tightly clamping the outer peripheral portion in its seating engagement to the one opposite side of the supporting member against the deforming displacement movement away therefrom in response to the bending moments created in the electrical contact due to the heat generated therein when it is electrically energized.

8. The method as set forth in claim 7 comprising the preliminary step of bending the integrally formed extensions so that they depend generally from the electrical contact for alignment with the openings in the supporting member so as to be passed therethrough in said passing step.

9. A method of making an electrical contact and assembling it to means for supporting it having a pair of opposite sides with a plurality of openings intersecting therebetween comprising the steps of:

a. integrally forming a plurality of means on a face of the contact at least closely adjacent an outer peripheral portion of the face for mounting the contact to the supporting means;

b. inserting the plurality of integrally formed means respectively through the openings in the supporting means and seating the outer peripheral portion in engagement with one of the opposite sides; and c. deforming respective end portions of the integrally formed means extending through the openings beyond the other of the opposite sides of the supporting means into clamping engagement with the other opposite side and laying at least a part of the deformed end portions over the outer peripheral portion in spaced relation therewith so as to establish forces preventing deforming displacement movement of the outer peripheral portion away from the one opposite side in response to bending moments created in the contact upon electrical energization heating thereof.

10. The method as set forth in claim 9 comprising the intermediate step of bending the integrally formed means so that they depend from the electrical contact for proper alignment with the openings in the supporting means prior to the inserting step.

11. An electrical contact adapted to be mounted to means for supporting it having a pair of opposite sides with a plurality of openings therebetween comprising an outer peripheral portion on said contact for seating engagement on one of the opposite sides of the supporting means, a plurality of integrally formed means on said contact disposed at least closely adjacent said outer peripheral portion for extending through the openings of the supporting means, respectively, and said integrally formed means respectively including means for engaging the other of the opposite sides generally about the openings, at least a part of each of said engaging means being adapted to overlay said outer peripheral portion with the supporting means tightly clamped therebetween so as to create forces in opposition to deforming displacement movement of said outer peripheral portion away from its seating engagement on the one opposite side of the supporting means in response to bending moments established in said contact upon electrical energization thereof when said contact is mounted to the supporting means.

12. An electrical assembly comprising an electrically conductive supporting member, a pair of opposite sides on said supporting member, a plurality of openings in said supporting member intersecting with said opposite sides thereof, an electrical contact including a body formed of electrically conductive material, a contact face on said body, a seating face on said body generally opposite said contact face thereof and having an outer peripheral portion disposed in seating engagement on one of said opposite sides of said supporting member, a marginal edge on said body extending generally about said outer peripheral portion, and a plurality of integrally formed extensions on said body predeterminately disposed at least closely adjacent said outer peripheral portion thereof protruding through said openings of said supporting member, respectively, and end portions on said integrally formed extensions extending beyond said openings adjacent the other of said opposite sides of said supporting member and deformed into engagement therewith generally about said openings so as to clamp said outer peripheral portion in its seating engagement to said one opposite side of the supporting member, said integrally formed extensions and said deformed end portions thereof generally constituting means for respectively establishing a plurality of forces acting on said outer peripheral portion in opposition to bending moments created in said contact generally between a central portion of said contact and said marginal edge in response to heating of said contact upon electrical energization thereof and acting to displace said outer peripheral portion away from its seating engagement on said one opposite side of said supporting member.

* * * * *